United States Patent [19]

Gater

[11] Patent Number: 4,472,953

[45] Date of Patent: Sep. 25, 1984

[54] PIN-TYPE LOCK WITH AXIAL SPLIT CYLINDER AND/OR PLUG

[75] Inventor: Arnold C. Gater, Anaheim, Calif.

[73] Assignee: Emhart Industries Inc., Farmington, Conn.

[21] Appl. No.: 463,038

[22] Filed: Feb. 1, 1983

[51] Int. Cl.[3] ..... E05B 9/04

[52] U.S. Cl. ..... 70/373; 70/375

[58] Field of Search ..... 70/364 A, 371–375; 76/101 A

[56] References Cited

U.S. PATENT DOCUMENTS

| | | | |
|---|---|---|---|
| 1,002,098 | 8/1911 | Voight . | |
| 1,003,957 | 9/1911 | Voight . | |
| 1,328,074 | 1/1920 | Bennet . | |
| 1,432,326 | 10/1922 | Freysinger | 70/373 |
| 3,429,154 | 2/1969 | Schwartz | 70/375 |
| 3,673,831 | 7/1972 | Nelson | 70/373 |
| 3,702,553 | 11/1972 | Nolin | 70/375 |
| 4,231,243 | 11/1980 | Thirion | 70/373 X |

*Primary Examiner*—Gary L. Smith

*Assistant Examiner*—Russell W. Illich

*Attorney, Agent, or Firm*—Mahoney & Schick

[57] ABSTRACT

A pin-type lock cylinder telescopes a rotatable lock plug with a multiplicity of generally axially and radially aligned pin holes formed in each and pins in the pin holes controlled by a key inserted axially into the plug for properly radially positioning the pins and permitting unlocking rotation of the plug. At least one of the cylinder and plug, and preferably both, are axially split members formed of generally diametrically opposed parts with the axial split passing through the axially aligned pin holes. One of the split member parts having an axially and radially flat surface extending continuously along said pin holes and forming one side of the pin holes with axial spacing therebetween, the other of the split member parts having axially spaced and radially extending grooves, preferably D-shaped cross section grooves, formed therein to complete the pin holes. The assembled cylinder pin hole grooves may face diametrically oppositely from the plug pin hole grooves, and the cylinder pin holes may be of slightly larger cross sectional dimension than the plug pin holes.

12 Claims, 8 Drawing Figures

PIN-TYPE LOCK WITH AXIAL SPLIT CYLINDER AND/OR PLUG

BACKGROUND OF THE INVENTION

This invention relates to a pin-type, key operated lock, and more specificially, to such a lock having at least one, and preferably both, of the cylinder and plug thereof continuously axially split and with the separation split thereof passing through an extreme side edge of each of the axially aligned pin holes. Thus, although one or both of the cylinder and plug are formed in this unique manner, once assembled into the pin-type key operated lock, they will operate in the usual manner and will be serviceable over a long period of useful life.

Most prior constructions of pin-type, key operated locks have had the cylinders and plugs thereof formed of individual single pieces, whether molded or otherwise fabricated, and then have had the necessary pin openings formed therein, as well as the key slots thereof. Obviously, the forming of the pin holes is a very exacting operation and relatively difficult to accomplish. Furthermore, it must be kept in mind that the cylinder pin holes must exactly properly align with the plug pin holes for proper operation of the ultimate lock.

One of the greatest difficulties encountered in forming these prior lock cylinders and plugs with their various aligned pin holes has been the formation of the pin holes between the cylinders and plugs with the exact alignment thereof while still accomplishing the same at reasonable production speed. These pin holes are extremely small in diameter and for many reasons a fair percentage thereof tend to lead off from their desired paths during the formation thereof. Thus, a relatively large percentage of scrap pieces are generated which otherwise would be proper lock parts.

There have been some prior attempts to form lock cylinders and/or plugs of axially split halves usually by die casting or forging. In all cases, the particular cylinder or plug has been formed by diametrically axially splitting the cylinder or plug exactly through the centers of the pin holes and then assembling the same into the final cylinder or plug. However, proper alignment of pin holes still provides an extreme problem and both halves of the cylinder or plug must be carefully formed and machined in order to accomplish the finally desired pin holes.

OBJECTS AND SUMMARY OF THE INVENTION

It is, therefore, an object of this invention to provide a pin-type, key operated lock wherein either or both of the lock cylinder and lock plug are axially split along a line serving as one axial edge of the pin holes so that one part of the pin holes is formed by a flat surface passing along each pin hole and between pin holes, while the other part has the pin holes formed therein as radially extending grooves, the joining of the two forming the axially aligned pin holes. Thus, the part of the pin holes formed in the one part is easily fabricated in view of it being a merely flat surface, and the portion of the pin hole formed in the other part, although a more complex configuration, is equally as well formed and without complication due to the fact that such grooves open completely toward the other part. Furthermore, not only are these parts more easily formed and with precise dimensions, but the assembly thereof is quickly accomplished forming the parts into a well known common lock which is usable over a long period of serviceable life.

It is a further object of this invention to provide a pin-type, key operated lock of the foregoing construction wherein in a preferred embodiment thereof, the pin holes in the one part thereof will always be of the flat configuration as described, but the pin holes formed in the other part thereof, although formed as grooves, may be of different groove configurations depending on the final formation of pin holes desired and the particular pins that are to operate therein. For instance, in a preferred form, the pin holes may be formed D-shaped in configuration, the D-shaped groove opening against the flat surface of the other part with round pins operating therein just as in the most common lock of this nature. However, if desired, other configurations of pins may be used, for instance, rectangular shaped pin holes with rectangular pins or oblong pin holes with oblong pins, without adding excessively to the pin hole and pin configuration. Obviously, great versatility of construction is provided while still making use of the principles of the present invention.

Other objects and advantages of the invention will be apparent from the following specification and the accompanying drawings which are for the purpose of illustration only.

DESCRIPTION OF THE BEST EMBODIMENTS CONTEMPLATED

Figure 7:
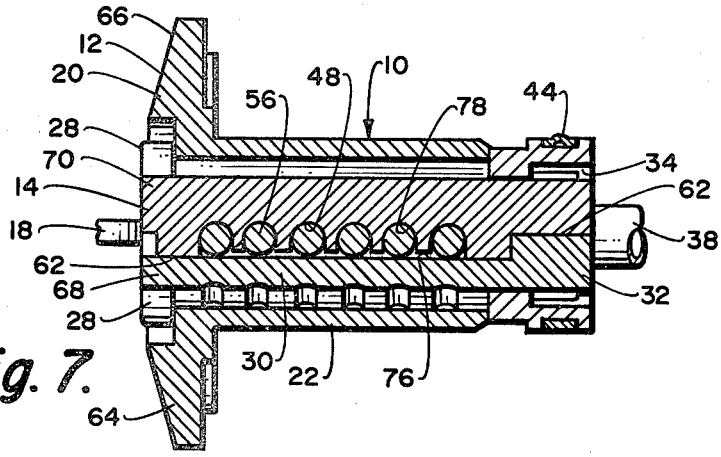
FIG. 7 is a horizontal sectional view looking in the direction of the arrows 7—7 in FIG. 5.
Figure 8:
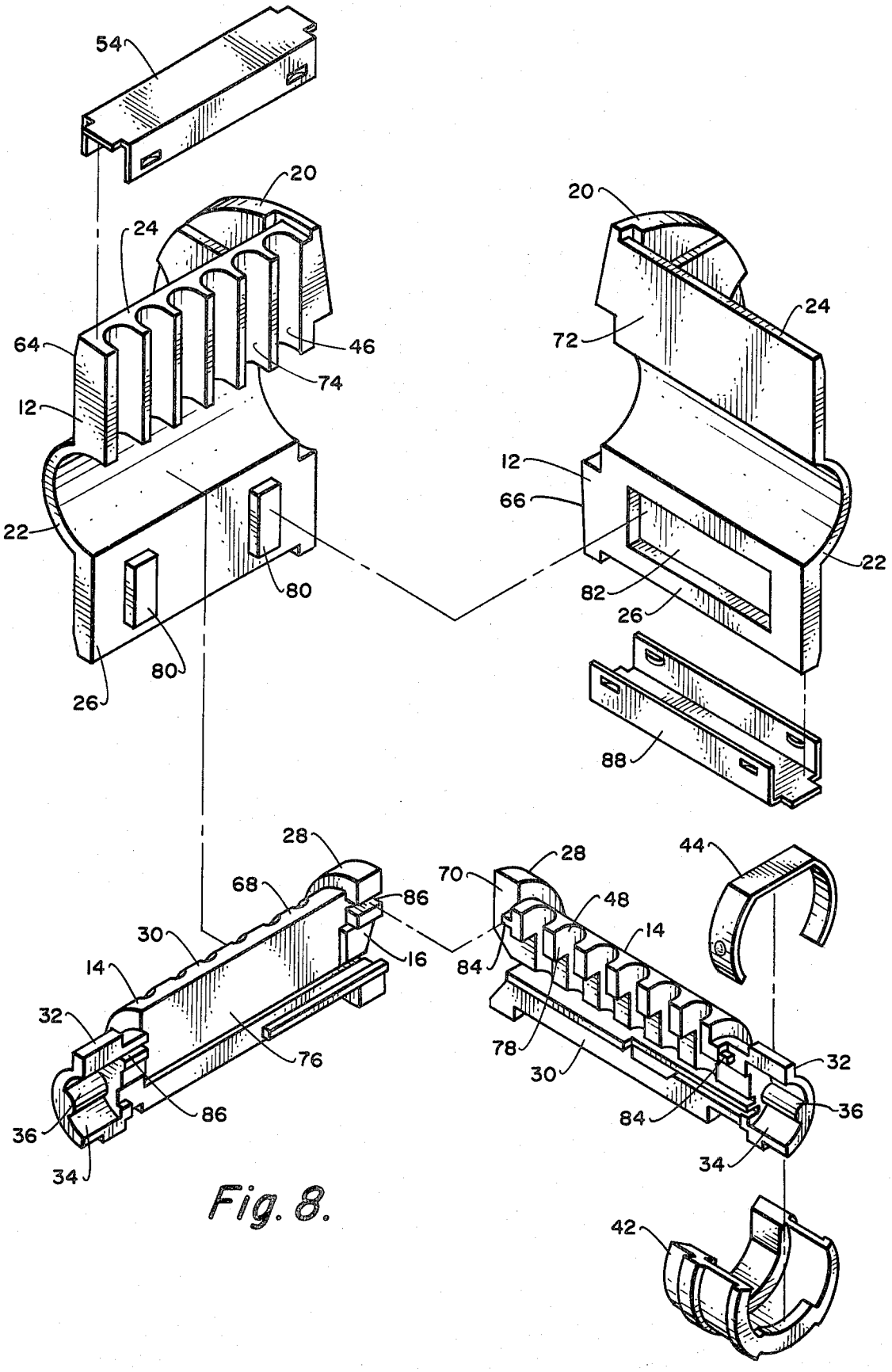
FIG. 8 is an exploded, perspective view of the lock with the key and torque blade removed.

Referring to the drawings, a pin-type, key operated lock is shown incorporating an embodiment of the split cylinder and/or plug principles of the present invention. FIGS. 1 through 7 illustrate the lock assembled in operable form and FIG. 8 is an exploded view showing most of the lock parts in disassembled view. Furthermore, the forward decorative cover has been removed in all views for increased clarity.

Initially considering the lock generally indicated at 10 in assembled condition and, for the moment, ignoring the cylinder and/or plug splitting principles of the present invention, the lock 10 includes a cylinder 12 which telescopes and rotatably mounts a plug 14, the plug having an upright or vertically extending key slot 16 receiving a usual key 18. The cylinder 12 at its forward end has a relatively short, face flange 20 and then projects rearwardly into hollow sleeve 22. At the rearward portion of the cylinder face flange 20 and extending rearwardly along the sleeve 22, the cylinder 12 is formed with a vertically upwardly extending pin holder portion 24. A clamping portion 26 is similarly positioned on the cylinder 12, but extending downwardly thereof, this clamping portion being for a particular purpose as will be hereinafter described.

Figure 3:
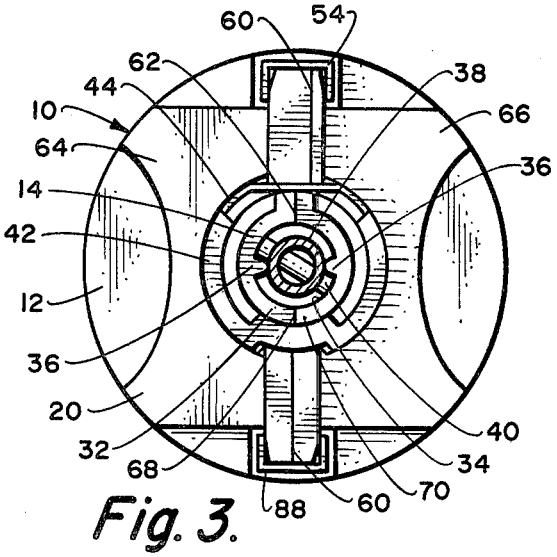
FIG. 3 is a rear view of the lock of FIG. 1 and with the key removed for clarity.
Figure 4:
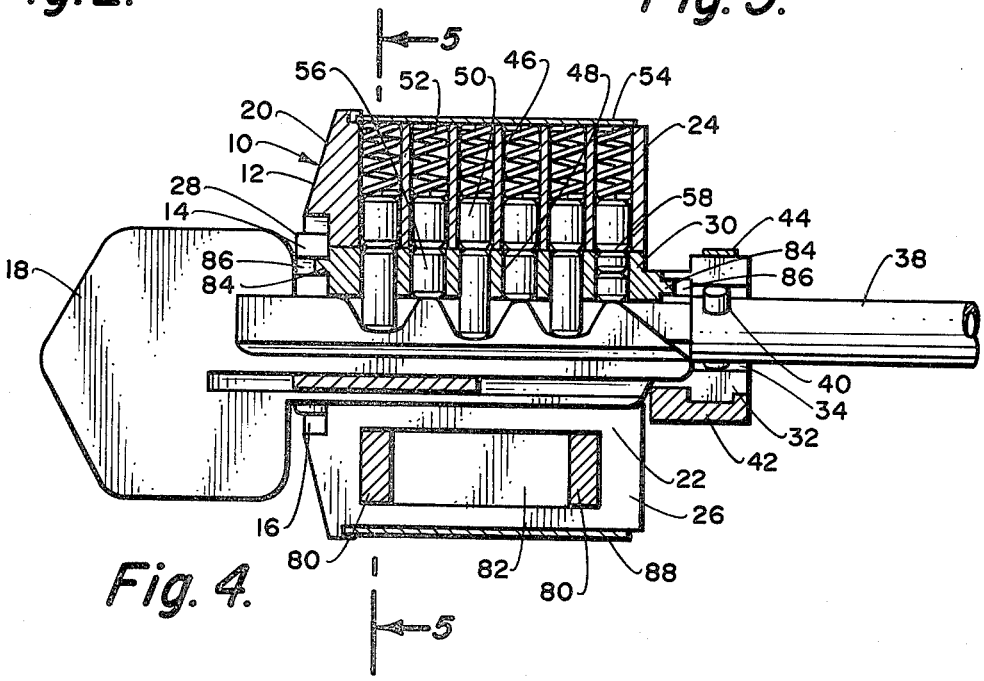
FIG. 4 is a vertical sectional view looking in the direction of the arrows 4—4 in FIG. 1.
Figure 5:
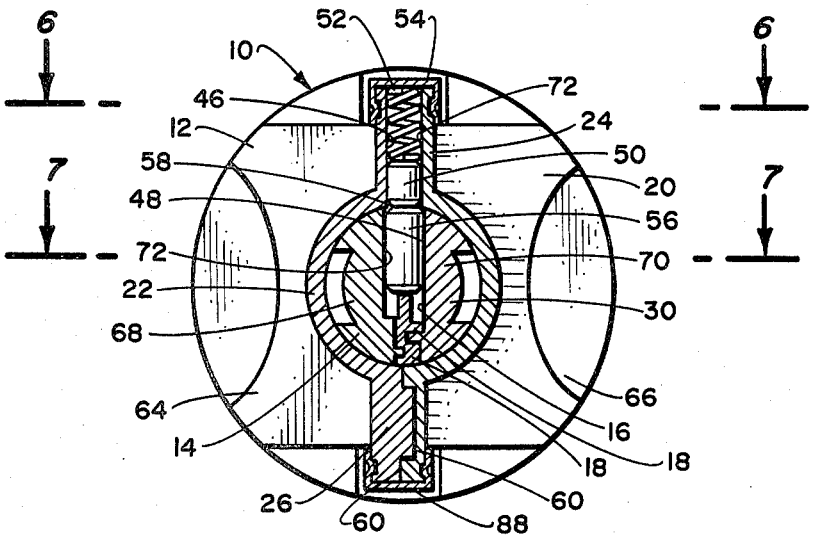
FIG. 5 is a vertical sectional view looking in the direction of the arrows 5—5 in FIG. 4.

The plug 14 has a relatively short front face flange 28 which has the majority thereof telescoped by the cylinder front face flange 20, and then the plug extends rearwardly covered by the cylinder sleeve 22 in a round cross section driver 30 ultimately exiting the cylinder sleeve in a lost motion drive connection 32. The plug drive connection 32 terminates rearwardly in a rearwardly opening socket 34 having opposite, inwardly extending interference members 36 at opposite sides thereof as seen in FIG. 3. As particularly seen in FIGS. 3 and 4, this adapts the socket 34 of the plug drive connection 32 for reception of a forward end of a torque blade 38 therein and having similar interference members 40 positioned for engagement with the plug interference members 36 to provide lost motion connection therebetween in usual manner. The torque blade is retained operable in the plug drive connection 32 as shown and adapts the torque blade in usual lost motion connection with the lock 10 for selective movement of latches and deadbolts by the lock 10 in the usual manner. Collar 42 and spring 44 will secure lock 10 to the knob assembly, not shown.

Still considering the lock 10 in assembled form and without regard to the cylinder and/or plug splitting principles of the present invention, the cylinder 12 in the sleeve 22 and pin holder portion 24 has a multiplicity of axially aligned pin holes 46 formed therein extending vertically upwardly from the plug 14. The plug 14 has similar radially extending and axially aligned pin holes 48 formed in the driver 30 thereof which, in the neutral position shown, align with the cylinder pin holes 46 as shown, for instance, in FIGS. 4 through 7. The cylinder pin holes 46 all open upwardly of the cylinder 12 and open downwardly against the plug driver 30, and the plug pin holes 48 open upwardly against the cylinder sleeve 22 and downwardly into the plug key slot 16.

The cylinder pin holes 46 have cylinder pins 50 of varying lengths positioned therein upwardly backed by pin springs 52 and which are covered by a generally snap-on pin holder cover 54. The plug pin holes 48 have similar plug pins 56 positioned therein outwardly abutting the cylinder pins 50 and inwardly either projecting into the key slot 16 or bearing against the configuration of the key 18 when the same is inserted into the lock 10. Thus, in the position shown, for instance, in FIGS. 4 and 5, a proper key will position the cylinder and plug pins 50 and 56 so that there is a parting line 58 precisely between the cylinder 12 and plug 14 permitting rotation of the plug for operating the lock 10 in the usual manner.

More particularly to the cylinder and/or plug splitting principles of the present invention, in this case both the cylinder 12 and plug 14, each is originally formed completely axially split as shown in FIG. 8 and then assembled together during the assembly of the lock 10 to finally form the finished lock. As shown, the cylinder 12 has the splitting line 60 which passes vertically through the face flange 20, the sleeve 22, the pin holder portion 24 and the clamping portion 26 so that somewhat diametrical halves are formed. The plug 14 is likewise formed with a splitting line 62 which passes vertically through the face flange 28, the driver 30, the lost motion drive connection 32 and the key slot 16.

Figure 1:
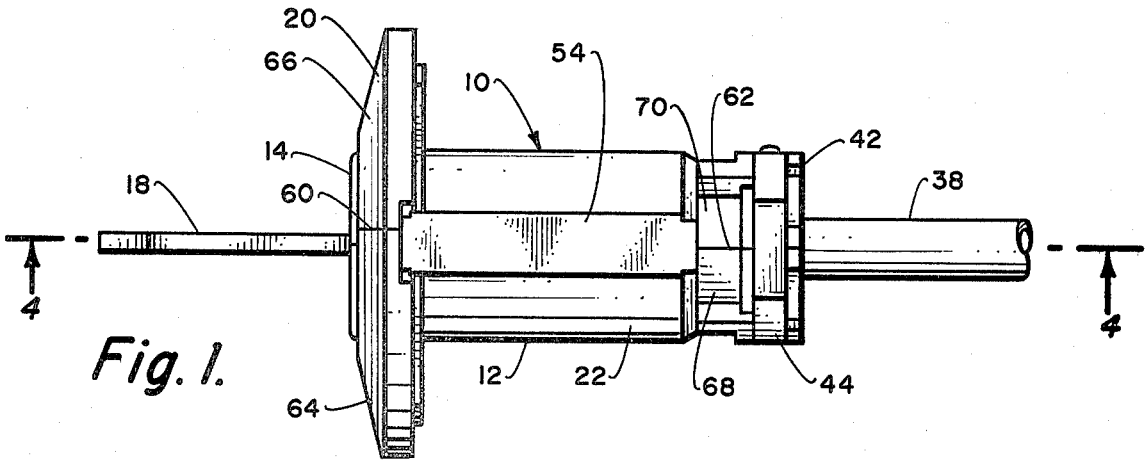
FIG. 1 is a top plan view of a pin-type, key operated lock incorporating the split cylinder and plug principles of the present invention, the lock being shown operably connected to a torque blade in fragmentary view.
Figure 2:
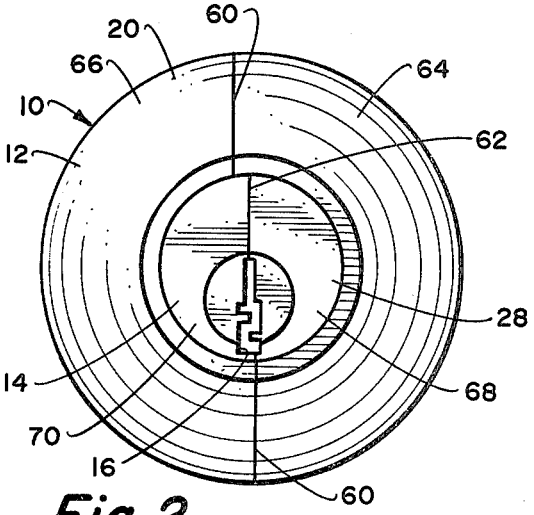
FIG. 2 is a front view of a the lock of FIG. 1, but with the key removed for clarity.

Thus, the cylinder splitting line 60 divides the cylinder 12 into somewhat diametrically opposed parts, as viewed from the front of the lock in FIG. 2, a cylinder right part 64 and cylinder left part 66. The plug 14 is similarly generally diametrically split into the plug right part 68 and the plug left part 70. Furthermore, and important to the principles of the present invention, each of the splitting lines 60 and 62 pass along one axially extending edge of all of the particular pin holes 46 and 48 of the cylinder and plug 12 and 14, in this case, the cylinder at one side and the plug at the other side.

Figure 6:
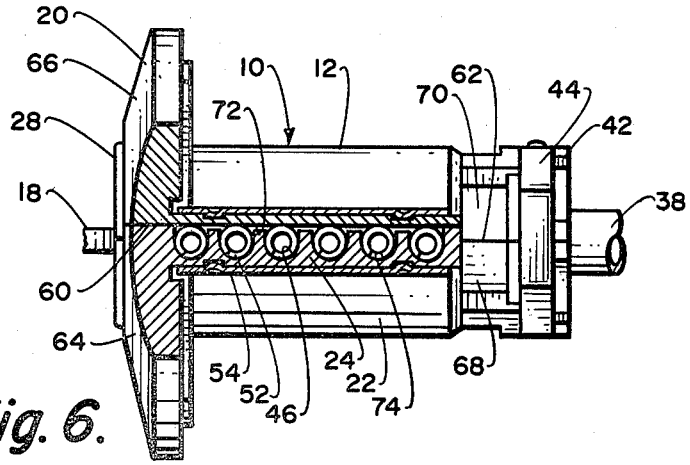
FIG. 6 is a horizontal sectional view looking in the direction of the arrows 6—6 in FIG. 5.

As viewed in FIG. 6, the cylinder splitting line 60 forms a flat surface 72 on the cylinder left part 66 completely by and between the cylinder pin holes 46 with a cylinder right part 64 having spaced, U-shaped holes or grooves 74 formed therein to complete the cylinder pin holes 46. The plug 14, as stated, is just oppositely formed as shown in FIG. 7, the plug right part 68 forms a flat surface 76 by and between the pin holes 48 with the plug left part 70 having the spaced holes or grooves 78 formed therein to complete the plug pin holes 48. It should be understood that the ultimately formed pin holes 46 and 48 are aligned in the neutral position of the lock 10 regardless of the manner of forming the same and that this formation for the particular embodiment shown is merely a matter of choice.

The particular sizes for the grooves 74 and 78 of the pin holes 46 and 48 are such that the pin holes accommodate round cross section pins, in this embodiment, the cylinder pins 50 and the plug pins 56. Also, the cylinder pin holes 46 are slightly larger than the plug pin holes 48, in this particular embodiment, cylinder pin holes of 0.125 diameter against plug pin holes of 0.120 diameter. However, it should be kept in mind that the principles of the present invention are not confined to use solely with the round pins and that the cylinder pin hole grooves and plug pin hole grooves could be formed of different relative size to accommodate other cross sections of pins such as square, rectangular, or oblong, all within the principles of the present invention.

In fabrication and assembly of the lock 10 from the cylinder 12 and plug 14, the cylinder right and left parts 64 and 66 and the plug right and left parts 68 and 70 are formed as shown in FIG. 8 by any usual manufacturing method, such as metal die casting. The cylinder right part 64 and the cylinder left part 66 are brought together into assembly forming the pin holes 46 as previously discussed and engaging blocks 80 into recess 82. It will be noted that the blocks 80 and recess 82 are formed in the cylinder clamping portion 26 and assembly of the cylinder 12 is retained by engaging the lower surface of the clamping portion with a generally U-shaped, snap cover 88 so that the cylinder right and left parts 64 and 66 will not separate.

The plug right and left parts 68 and 70 are similarly assembled including the formation of the plug pin holes 48 as previously described and further including engaging bars 84 and 86. The plug 14 can then be inserted from the front into the cylinder 12, the various pins 50 and 56 backed by the pin springs 52 inserted into the pin holes 46 and 48, and the pin holder cover 54 snapped into place, the latter serving to hold the pins and their springs in place as well as retaining the entire cylinder assembly. The collar 42 and its spring 44 may be finally assembled to retain the entire lock assembly.

According to the principles of the present invention, therefore, a pin-type, key operated lock, the lock 10, is provided having one or both of the cylinder 12 and plug 14 thereof axially split, yet in final assembly, the lock operates in a usual manner. In the particular embodiment shown, both the cylinder 12 and plug 14 are split and the line of split axially is along one side of the pin holes 46 and 48. Thus, one part of each of the cylinder 12 and plug 14 may be formed as a flat surface and the other parts of each are formed of grooves, thereby simplifying the relative construction while gaining all of the advantages of this novel splitting. The critically formed pin holes in each of the cylinder 12 and plug 14 may be much more easily formed in the various split parts prior to the assembly of such parts and the aligned pin forming and its many problems with the prior constructions are completely eliminated.

Although the principles of the present invention have been herein illustrated in a particular embodiment of lock construction, it is not intended to limit such principles to that construction alone, since the same principles are readily applicable to various other forms of lock construction. Thus, the principles of the present invention should be broadly construed and not limited beyond the specific limitations set forth in the appended claims including the patent equivalents thereof.

I claim:

1. In a lock of the general type having a lock cylinder telescoping a rotatable lock plug with a multiplicity of generally axially and radially aligned pin holes formed in each, cylinder and plug pins in the pin holes controlled by a key inserted axially into the plug properly radially positioning the pins and permitting unlocking rotation of the plug; the improvements including: at least one of said cylinder and plug being an axially split member formed of at least generally diametrically opposed parts with the axial split passing through said axially aligned pin holes, one of said split member parts having an axially and radially flat surface extending continuously along said pin holes and forming one side of said pin holes with axial spacing therebetween, the other of said split member parts having axially spaced and radially extending grooves formed therein to complete said pin holes.

2. In a lock as defined in claim 1 in which said grooves forming said pin holes in said other split member part are D-shaped in cross section with a flat of said D-shaped grooves mating with said flat surface of said one split member part.

3. In a lock as defined in claim 1 in which both of said cylinder and plug are axially split members with one of said split member parts of each having said flat surface and the other of said split member parts of each having said grooves.

4. In a lock as defined in claim 1 in which both of said cylinder and plug are axially split members with one of said split member parts of each having said flat surface and the other of said split member parts of each having said grooves; and in which said grooves of the other of said split member parts of each are D-shaped in cross section having flats thereon mating with said flat surfaces of said one of said split member parts of each.

5. In a lock as defined in claim 1 in which both of said cylinder and plug are axially split members with one of said split member parts of each having said flat surface and the other of said split member parts of each having said grooves; and in which said cylinder pin holes measured in cross section are slightly larger than said plug pin holes.

6. In a lock as defined in claim 1 in which both of said cylinder and plug are axially split members with one of said split member parts of each having said flat surface and the other of said split member parts of each having said grooves; in which said grooves of the other of said split member parts of each are D-shaped in cross section having flats thereon mating with said flat surfaces of said one of said split member parts of each; and in which said cylinder pin holes measured in cross section are slightly larger than said plug pin holes.

7. In a lock as defined in claim 1 in which both of said cylinder and plug are axially split members with one of said split member parts of each having said flat surface and the other of said split member parts of each having said grooves; and in which said cylinder grooves face diametrically opposite from said plug grooves.

8. In a lock as defined in claim 1 in which both of said cylinder and plug are axially split members with one of said split member parts of each having said flat surface and the other of said split member parts of each having said grooves; in which said cylinder grooves face diametrically opposite from said plug grooves; and in which said grooves of the other of said split member parts of each are D-shaped in cross section having flats thereon mating with said flat surfaces of said one of said split member parts of each.

9. In a lock as defined in claim 1 in which both of said cylinder and plug are axially split members with one of said split member parts of each having said flat surface and the other of said split member parts of each having said grooves; in which said cylinder grooves face diametrically opposite from said plug grooves; and in which said cylinder pin holes measured in cross section are slightly larger than said plug pin holes.

10. In a lock as defined in claim 1 in which both of said cylinder and plug are axially split members with one of said split member parts of each having said flat surface and the other of said split member parts of each having said grooves; in which said cylinder grooves face diametrically opposite from said plug grooves; in which said grooves of the other of said split member parts of each are D-shaped in cross section having flats thereon mating with said flat surfaces of said one of said split member parts of each; and in which said cylinder pin holes measured in cross section are slightly larger than said plug pin holes.

11. In a lock as defined in claim 1 in which both of said cylinder and plug are axially split members with one of said split member parts of each having said flat surface and the other of said split member parts of each having said grooves; and in which said cylinder and plug pins are round cross section pins.

12. In a lock as defined in claim 1 in which both of said cylinder and plug are axially split members with one of said split member parts of each having said flat surface and the other of said split member parts of each having said grooves; in which said grooves of the other of said split member parts of each are D-shaped in cross section having flats thereon mating with said flat surfaces of said one of said split member parts of each; and in which said cylinder and plug pins are round cross section pins.

* * * * *